US005407389A

United States Patent [19]

Poblete et al.

[11] Patent Number: 5,407,389

[45] Date of Patent: Apr. 18, 1995

[54] FUME HOOD

[75] Inventors: Rudolph Poblete, Statesville; Kurt Rindoks, Cornelius, both of N.C.

[73] Assignee: Kewaunee Scientific Corporation, Statesville, N.C.

[21] Appl. No.: 60,592

[22] Filed: May 11, 1993

[51] Int. Cl.[6] ..... B08B 15/02

[52] U.S. Cl. ..... 454/56

[58] Field of Search ..... 454/56, 57, 60

[56] References Cited

U.S. PATENT DOCUMENTS

| | | | |
|---|---|---|---|
| 3,041,957 | 7/1962 | Liptay . | |
| 3,049,069 | 8/1962 | Whiston et al. . | |
| 3,284,148 | 11/1966 | Ramniceanu . | |
| 3,318,076 | 5/1967 | Baker | 454/56 X |
| 3,895,570 | 7/1975 | Eagleson, Jr. | 454/57 |
| 4,142,458 | 3/1979 | Duym | 454/56 |
| 4,280,400 | 7/1981 | Longworth . | |
| 4,409,890 | 10/1983 | Longworth . | |
| 4,632,022 | 12/1986 | Baitinger | 454/56 |
| 5,056,422 | 10/1991 | Horntvedt | 454/57 |

FOREIGN PATENT DOCUMENTS

| | | | |
|---|---|---|---|
| 2112129 | 7/1983 | United Kingdom | 454/56 |

*Primary Examiner*—Harold Joyce
*Attorney, Agent, or Firm*—Hill, Steadman & Simpson

[57] ABSTRACT

A fume hood defines a ventilated and enclosed work space surrounded by two opposed side panels, a rear panel connected between the side panels, and a top panel, with an access opening formed at the front of the enclosed work space between front-facing edges of the side panels. The side panels and rear panel of the fume hood are double-walled, defining interior flow spaces in fluid communication with each other. The interior flow space of the rear panel is in fluid communication with a negative pressure source and with the enclosed work space through egress openings formed on the interior wall thereof, such that contaminated air may be withdrawn from the work space by the negative pressure source and discharged to a benign area. The front-facing edges of the side panels are formed with ingress openings, in flow communication with the negative pressure source through the interior flow spaces, such that air flow through the ingress openings creates a negative pressure area adjacent the front edges and interior surfaces of the side panels, which then causes air flow entering the access opening to follow the contours of the side panels, reducing air turbulence and back flows. By avoiding the production of eddies and back flows at the front of the fume hood, undesirable outward forward movement of contaminated air from the work space is avoided or otherwise reduced.

15 Claims, 2 Drawing Sheets

FIG. 1
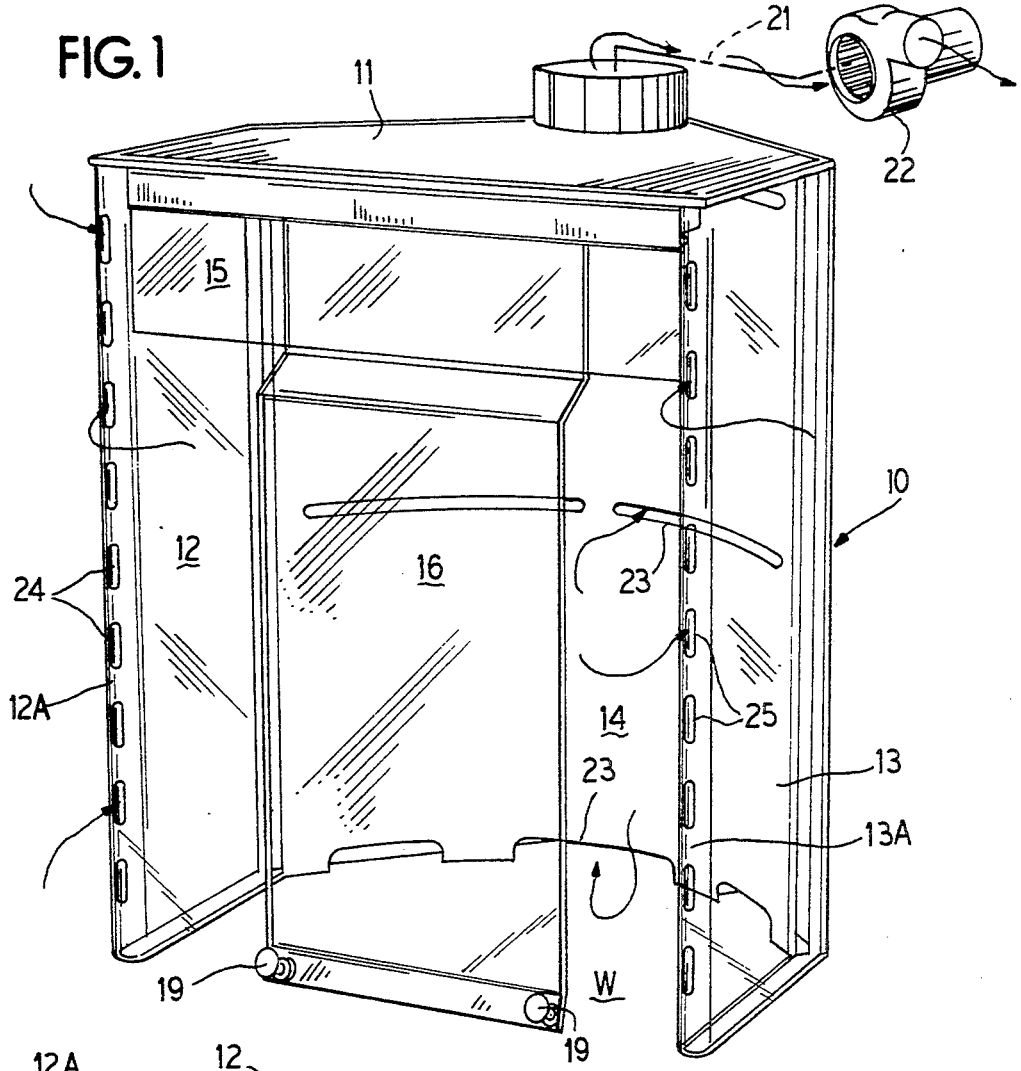
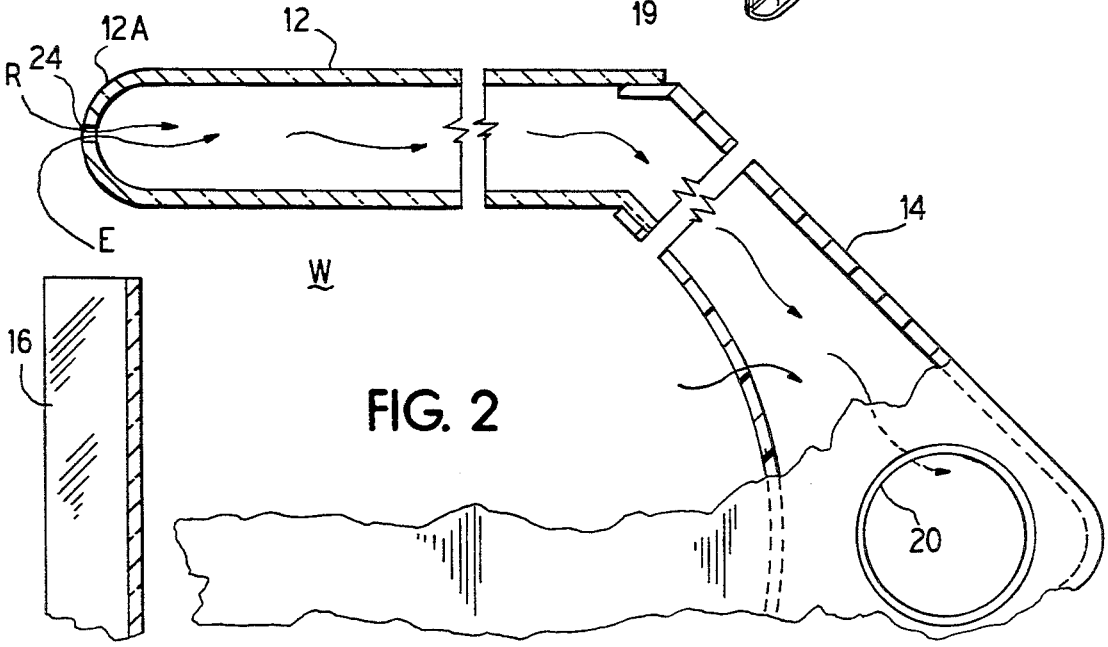
FIG. 2

FUME HOOD

BACKGROUND OF THE INVENTION

The present invention relates to a fume hood apparatus, and more particularly to a fume hood apparatus which produces air flows designed to avoid or otherwise minimize undesirable air turbulence and back flows to improve containment.

A fume hood is a form of ventilated enclosure defining a work space within which a person may extend his arms to conduct experiments, manufactures, or other operations and in which noxious gases, vapors, or the like may arise. To avoid release of the noxious material out into a room in which people may be working, the fume hood is associated with a negative pressure source, such as a fan, for drawing air and noxious material from the enclosure for safe discharge. The fume hood is provided with a front opening which allows access to the enclosure and through which air is drawn to replace that withdrawn by the fan. Examples of known fume hood apparatus are shown by U.S. Pat. Nos. 5,056,422 and 3,041,957.

A problem with known fume hoods, however, is that the flow of air through the access opening is not streamlined and turbulences and eddies are formed, particularly along side walls and in corners of the enclosure, which result in work space air and hence noxious material flowing back through the access opening and out into the room. One effort toward solving this obviously undesirable situation of possible back flow of work space gases, vapors, etc. is to provide cowling over the edges of the access opening such that the air flow over the cowling is streamlined (i.e. smooth) and substantially free of eddies, as disclosed in U.S. Pat. No. 4,409,890. However, the addition of cowling structure to the fume hood access opening unnecessarily complicates the fume hood structure.

SUMMARY OF THE INVENTION

In accordance with this invention, a fume hood apparatus is defined by an enclosure which is ventilated by a fan for drawing air and noxious material from the enclosure for safe discharge and which has a front opening which allows access to the enclosure and through which air is drawn to replace that withdrawn by the fan. The fume hood enclosure is basically formed by a roof, a pair of side panels having front edges along the sides of the access opening, and a rear panel connected to the rear edges of the side panels. The side and rear panels of the fume hood are double-walled forming hollow interiors. The suction side of the fan is in flow communication with the interior space of the rear panel, and at least the rear panel is formed with egress openings communicating with the interior of the enclosure for drawing flow of air and noxious material from the enclosure, through the hollow space, and to the fan. The front free edges of the side panels on both sides of the access opening are provided with a series of ingress openings running along the vertical length thereof. These ingress openings are in flow communication with the respective interior space of the side panels, which in turn is in flow communication with the interior space of the rear panel.

In accordance with the invention, the ingress openings on the side panels draw in ambient air and produce a negative or low pressure region, by virtue of air induction, adjacent the interior of the access opening. This air flow situation thus causes the air actually entering into the fume hood through the access opening to more desirably follow the contours of the side panels, thus reducing the possibilities for air turbulence and back flows. Without the ingress openings, the air entering the access opening pulls away from the side panels causing turbulence and back flows in the area immediately adjacent to the interior of the access opening, which increases the chances that noxious material can escape from the fume hood.

In accordance with the preferred embodiment, a table top fume hood apparatus is described. It will be appreciated, however, that the present invention has application to the array of fume hood or ventilated enclosure structures, and is not limited to a table top embodiment.

BRIEF DESCRIPTION OF THE DRAWINGS

FIG. 1 is a perspective view of a fume hood embodiment constructed in accordance with the invention.

FIG. 2 is a cut-away top plan view of a side panel and rear panel segment of the fume hood of FIG. 1.

DETAILED DESCRIPTION OF THE PREFERRED EMBODIMENT

FIGS. 1–5 illustrate one embodiment of a fume hood apparatus of the present invention at 10. The fume hood 10 is a table top fume hood suitable for use in instructional chemistry laboratories in high schools and colleges, to provide aerial containment for gases, vapors, and other noxious materials generated, for example, in the course of chemical experiments or the like. The fume hood 10 is designed to be portable in the sense that it can be placed over a flat surface, such as a table top, to define an enclosed work space over that surface and using the flat surface as the floor of the fume hood.

Figure 5:
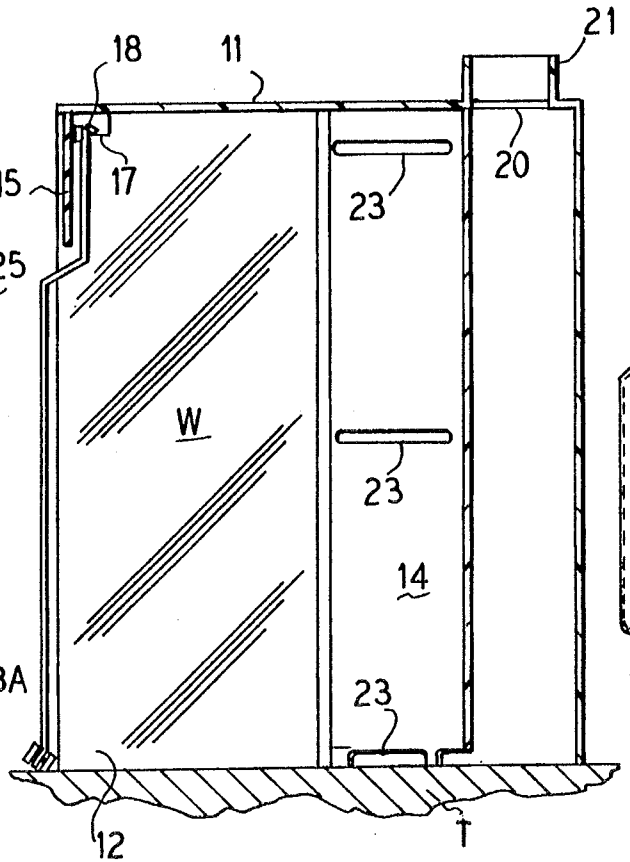
FIG. 5 is a sectional view taken along the lines V—V of FIG. 4 and illustrates the table on which the fume hood is placed.

The fume hood 10 generally includes a roof or top panel 11, two side panels 12 and 13, and a rear panel 14. The fume hood 10 has an open bottom, the floor of the fume hood being formed by the flat surface on which it is placed, such as a table top T as shown in FIG. 5. The front edges 12A and 13A of the side panels 12 and 13 are essentially free-standing and define therebetween an opening which allows access to an enclosed work space W bounded by the roof 11, side panels 12 and 13, and rear panel 14. The access opening may be partially closed by a front panel 15, extending downward from the roof and between the side panels 12 and 13. In addition, the access opening at the front of the fume hood is preferably further partially closed by a sliding window panel 16.

Figure 4:
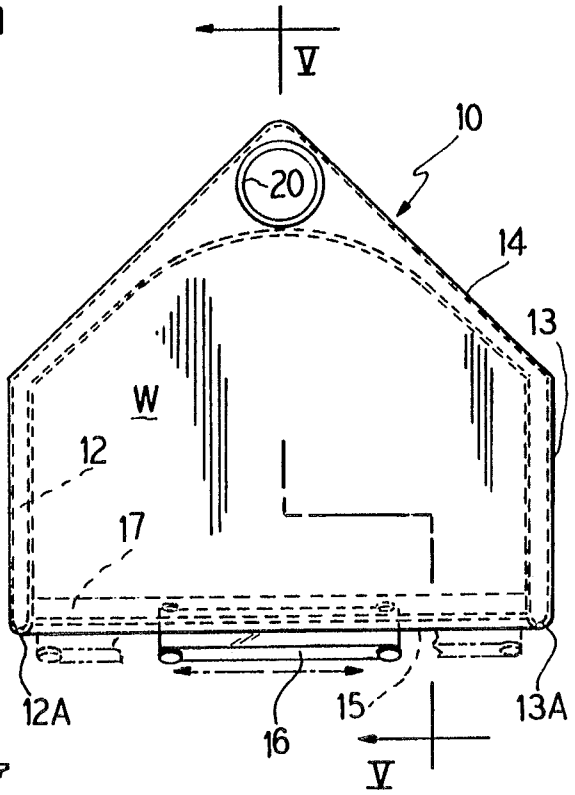
FIG. 4 is a top plan view of the fume hood of FIG. 1.
Figure 3:
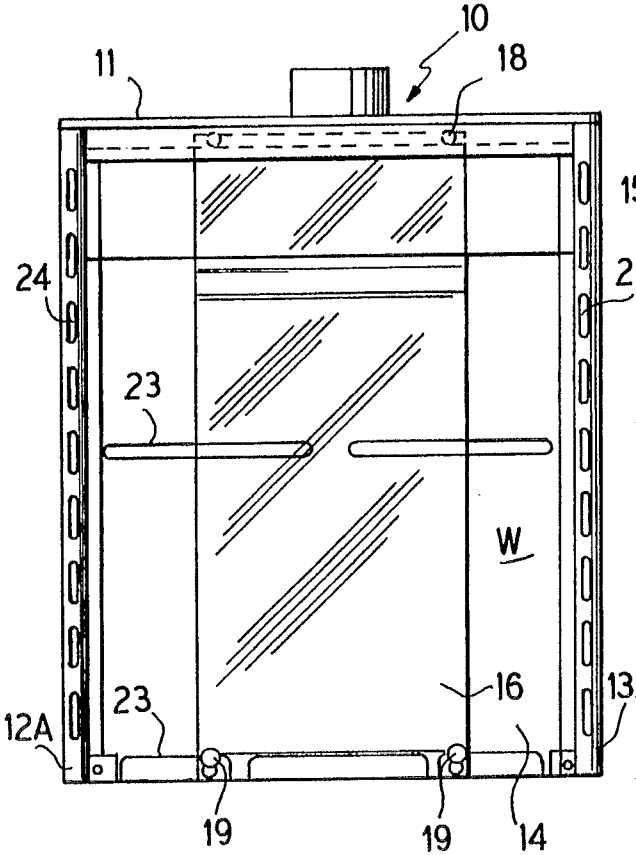
FIG. 3 is a front elevational view of the fume hood of FIG. 1.

As shown in FIGS. 3–5, the window panel 16 extends essentially the height of the fume hood, and is supported on a track element 17 extending from the roof 11 and running the width of the access opening. The upper end of the door panel 16 is formed with support pins 18 by which the panel hangs on the track 17 and is slidably disposed therealong. The operator moves the window panel to one side or the other within the access opening by engaging knobs 19 formed at the lower end of the window panel. The window panel 16 is disposed within the area of the access opening, and occupies less than the total area of that opening.

Each of the side panels 12 and 13 and the rear panel 14 are double-walled, defining an interior hollow space between the walls. The front free edges 12A and 13A of the side panels are closed, whereas their rear-facing edges are open for interconnection with open side edges of the rear panel 14. The interior hollow space of the rear panel 14 is in flow communication with an outlet opening 20 formed in the roof 11. The opening 20 is connected by suitable ducting 21 to the intake for a high volume centrifugal fan 22, or other suitable device, which serves to build up a negative pressure in the hollow flow space of the rear panel 14. The interior wall of the rear panel 14 is formed with suitable egress openings 23 establishing a flow communication between the enclosed work space W of the fume hood and the hollow interior of the rear panel 14. Thus, the negative pressure developed by the fan 22 in the rear panel hollow space draws the flow of air, fumes, or other noxious gases in the enclosed work space through the egress openings 23 in the rear panel, through the interior hollow space of the rear panel, and out through the outlet opening 20 for evacuation by the fan 22 to a benign discharge area.

Within a typical fume hood apparatus, undesirable eddies and back flows occur at areas adjacent the interior of the access opening producing a forward flow of enclosure air and noxious material along the side walls directed out through the opening and into the room where the operator and others could be affected. To eliminate or otherwise reduce the generation of such troublesome turbulences and back flows within the enclosure work space W, the front-facing edges 12A and 13A of the side panels 12 and 13 are respectively formed with a series of ingress openings 24 and 25 running along the vertical length of the side panel front edges and communicating directly with the hollow interior spaces of the side panels. The hollow interior spaces of the side panels 12 and 13 are each respectively in flow communication with the interior hollow space of the rear panel 14. Thus, the negative pressure developed in the hollow interior of the rear panel 14 is communicated to the ingress openings 24 and 25, as well as to the egress openings 23, to induce flows of ambient air therethrough along both sides of the access opening. The ingress of ambient air through the openings 24 and 25 serves as an induction to produce a negative or low pressure in the adjacent area. This negative or low pressure is formed along and adjacent the interior of the access opening, and will be referred to as an ambient induction zone.

As shown with reference to FIG. 2, the low pressure formed at the ingress openings 24 and 25 draws in ambient room air R which in turn creates, through the process of induction produced by the flow of room air through the openings, a flow of air E adjacent the front edges of the side panels into the openings. This flow movement E produces the ambient induction zone adjacent the front edges of the side panels and extending inward of the access opening along the interior surfaces of the side panels. The negative pressure adjacent the interior surfaces of the side panels in the area of their front edges then causes the air entering the fume hood through the access opening to follow the contours of the side panel interior walls, eliminating or otherwise reducing air turbulence and back flows which heretofore had produced the forward flow of air along the side walls directed outward from the access opening. The air flow thus entering into the work space W along the sides of the access opening is thus less prone to turbulence and there is a more smooth transition of air flows from outside the access opening to air flows inside the fume hood.

In keeping with the goal of the invention to reduce troublesome eddies and back flows from developing within the work space W, which can produce a forward flow of contaminated air towards the access opening, the interior wall of the rear panel 14 is given a curvilinear shape, as shown in FIG. 4. The curvilinear shape to the rear panel interior wall thus enables the interconnection between the rear edges of the side panels and the side edges of the rear panel to present a more smooth surface transition for the work space air flows, than would occur if a box corner was formed. Box corners typically create eddies in nearby air flows, which eddies can inhibit the efficiency of air evacuation from the work space. The curvilinear shape of the interior wall of the rear panel 14 further enhances the smooth flow of air through the work space and out the egress openings 23, which makes the process of air replenishment within the fume hood work space and contaminated air evacuation from the fume hood work space more efficient.

In completing description of the preferred embodiment, it will also be noted that the side panels 12 and 13, front panel 15 and window panel 16 are preferably made of transparent material, such as plexiglass, to permit easy viewing of the enclosed work space defined by the fume hood 10. It would be expected that the front panel 15 and window panel 16 would be made of transparent material to enable the operator to readily observe his operations in the fume hood. However, it is also considered desirable, especially in the context of this table top fume hood embodiment which would be expected to be used in an instructional setting, to make the side panels 12 and 13 transparent so that individual standing anywhere around the fume hood may easily observe the activity within the hood. Alternatively, of course, the side panels 12 and 13 may be constructed of suitable translucent or opaque material. It is contemplated that the rear panel 14 would be constructed of an opaque material, such as a high strength plastic. Due to the intended portability of this table top hood embodiment, it would be expected that the construction materials would be selected to be lightweight.

It will be understood by those skilled in the art that the shape, size, and arrangement of slot openings along the front edges of the side panels could be varied from that as shown in the drawings without departing from the spirit of the instant invention. Other engineering modifications to that which has been described herein may occur to those versed in the art without departing from the spirit of the instant invention. It should be understood that I wish to embody within the scope of the patent warranted hereon all such modifications as reasonably and properly come within the scope of my contribution to the art. The inventive concept should not be limited except as described in the appended claims, which include all similar structure operating in substantially the same manner to obtain substantially the same results.

We claim as our invention:

1. For use in a ventilated enclosure defining a work space in flow communication with a negative pressure source and having an access opening at a front end thereof through which ambient air is drawn into said work space, side panels having front-facing edges spaced apart on opposed sides of said access opening, each side panel being formed with a hollow interior space in flow communication with said negative pressure source, and said side panel front-facing edges being formed with front-facing only ingress openings in flow communication with said respective side panel's hollow interior space, whereby ambient air is also drawn through said ingress openings creating a respective ambient induction zone adjacent each side of said access opening.

2. The ventilated enclosure of claim 1, wherein each side panel front-facing edge is formed with a series of ingress openings extending along the length of said edge.

3. The ventilated enclosure of claim 1, wherein said side panels are made of transparent material.

4. The ventilated enclosure of claim 1, further having a rear panel extending between rear-facing edges of said side panels and said rear panel formed with a hollow interior space in flow communication with said side panel hollow interior spaces and said negative pressure source.

5. The ventilated enclosure of claims 1 or 4, being portable and having an open bottom.

6. The ventilated enclosure of claim 4, wherein the surface of said rear panel facing said work space has a curvilinear shape.

7. The ventilated enclosure of claim 1, having a window panel disposed within the area of said access opening, said window panel occupying less than the total area of said access opening.

8. The ventilated enclosure of claim 7, wherein said window panel is disposed for sliding movement back and forth across said access opening.

9. A fume hood comprising a housing defining an enclosed work space for connection to a negative pressure source, said housing having a top panel overlying said work space, a pair of side panels on opposed sides of said work space and having free-standing front edges with a front-facing access opening formed therebetween and through which ambient air is drawn into said work space, and a rear panel connected to rear edges of said side panels defining the back of said work space, said rear panel having a hollow interior space in flow communication with said negative pressure source and in flow communication with said work space, said side panels each having a hollow interior space in flow communication with said rear panel hollow interior space, and said side panel front edges having front-facing only ingress openings in flow communication with said respective side panel hollow interior space, whereby ambient air is also drawn through said ingress openings creating a respective ambient induction zone adjacent each side of said access opening.

10. The ventilated enclosure of claim 9, wherein each side panel front-facing edge is formed with a series of ingress openings extending along the length of said edge.

11. The ventilated enclosure of claim 9, wherein said side panels are made of transparent material.

12. The ventilated enclosure of claim 9, being portable and having an open bottom.

13. The ventilated enclosure of claim 9, wherein the surface of said rear panel facing said work space has a curvilinear shape.

14. The ventilated enclosure of claim 9, having a window panel disposed within the area of said access opening, said window panel occupying less than the total area of said access opening.

15. The ventilated enclosure of claim 14, wherein said window panel is disposed for sliding movement back and forth across said access opening.

* * * * *